United States Patent [19]

Larwood

[11] 4,443,010

[45] Apr. 17, 1984

[54] PSYCHIC CONNECTION GAME

[76] Inventor: Laurie G. Larwood, 9812 Lindero Ave., Montclair, Calif. 91763

[21] Appl. No.: 340,063

[22] Filed: Jan. 18, 1982

[51] Int. Cl.[3] ..... A63F 3/00

[52] U.S. Cl. ..... 273/242

[58] Field of Search ..... 273/273, 1 R, 242, 141 R, 273/236

[56] References Cited

U.S. PATENT DOCUMENTS

| | | | |
|---|---|---|---|
| 2,587,242 | 2/1952 | Stringer | 273/141 R |
| 3,124,358 | 3/1964 | Weedman | 273/249 |
| 3,378,261 | 4/1968 | Schriber | 273/273 |
| 3,764,135 | 10/1973 | Madison | 273/1 R |
| 3,768,176 | 10/1973 | Huddleston | 35/22 R |
| 3,777,413 | 12/1973 | Zaccheo | 35/22 |

*Primary Examiner*—Richard C. Pinkham
*Assistant Examiner*—Matthew L. Schneider
*Attorney, Agent, or Firm*—Leo R. Carroll

[57] ABSTRACT

A game for evaluation and development of various psychic abilities between its participants. Objects are furnished which include bi-valued dimensional attributes, such as rough-smooth, solid-hollow, or heads-tails. A player concentrates on a chosen attribute and attempts to either transmit, receive, block, predict, or influence a given valued condition. A gameboard is provided on which a player's successes are marked by position of his player-piece or counter on the board. Counter positions are marked with the chance probability of reaching a given position from a start position in a given number of moves. Board layout is such that if the incidence of successes is greater than that expected by random chance alone, counters are moved toward another player, thereby establishing a higher degree of psychic connectivity.

6 Claims, 3 Drawing Figures

PSYCHIC CONNECTION GAME

BACKGROUND OF THE INVENTION

This invention relates generally to the field of games, and more particularly to one which is useful for both entertainment and for testing of psychic connectivity between players.

Recognition, study, and development of our paranormal senses has been a frontier of psychology for over a century. The most widely known phenomena include telepathy, clairvoyance, a precognition, and psychokinetic powers. This game provides an organized method of evaluating all four powers against both chance and a competitor.

Testing of a few individual abilities have been accomplished in college lab experiments, primarily involving playing cards. A few have been organized into games.

For example, U.S. Pat. No. 2,587,242 to A. C. Stringer is illustrative of a typical game in which the results achieved by a player are dependent upon his success in anticipating the opponent's move. Weedman, in U.S. Pat. No. 3,124,358, describes a psychology game in which participants try to select from a variety of responses to given situations, a best response relative to a predetermined scoring system, but does not have the element of opponent anticipation. In U.S. Pat. No. 3,764,135, Madison purports to measure empathy by comparing a player's prediction of a role playing opponent's reaction to situational stimuli.

None of the above games are designed around the transmittal of psychic images. A need exists morever for an instrument which may also be used to test, stimulate, and develop a broad spectrum of psychic powers, as well as provide the pleasures of game playing and mental comparison with others. The skill spectrum covered includes telepathy (mind reading), clairvoyance (visions of activity elsewhere), precognition (future prediction), and psychokinetic sense (ability to move or influence outside objects or events). In addition, repeat playing under different environmental conditions can indicate the situational sensitivity of one's psychic powers.

SUMMARY OF THE INVENTION

It is therefore, a primary object of this invention to provide an educational game to test for the relative existence of four separate psychic abilities.

It is a further object to provide an educational game which indicates telepathic ability.

It is a further object to provide an educational game which indicates clairvoyant ability.

It is a further object to provide an educational game which indicates precognitive ability.

It is a further object to provide an educational game which indicates psychokinetic ability.

It is a further object to provide a game board implementation which provides instant comparison of actual results achieved with those which would result from statistical probability alone.

It is a further object of the game to provide a single game to determine both psychic transmission and/or reception abilities.

The invention takes the form of a game board with movement positions in accordance with an arithmetic probability series, a plurality of counters for recording players status, a plurality of three dimensional physical objects possessing opposite two-way dimensional characteristics.

A player selects a particular dimension of an object and, when evaluating telepathy, tries to either transmit or block the mental transmission of his selected characteristic. The other player then tries to receive the image and, if correct, moves his counter downward and toward his opponent's side of the board. Various degrees of psychic connection is said to be made as players move counters closer to each other than would occur by chance alone. Probabilities of being in given board positions are indicated on the board and provide instant feedback of success.

When evaluating clairvoyance, a player tries to visualize an event which has already occurred. An event consists of the random, or blind selection of a dimensional attribute by the other player. A die can be used to provide a blind selection between opposite characteristics such as the on or off state of a light source. A correct later visualization by a player again results in movement of his counter in the down-right direction, with indicated board probabilities showing improvement over chance.

When evaluating precognitive ability, the player attempts to visualize an event which has not yet happened. The player first predicts the event, followed then by random selection and performance of the event by the other player. As in clairvoyance, a supporting implement such as a die may be used for a blind selection of an on-off condition of another supporting implement such as a candle. Movement and success scoring then follows as above.

Finally, when evaluating psychokinesis, the player attempts to influence or cause the event outcome. One or both players concentrate on producing the event before its happening and simultaneously through its happening. They may of course cooperate in trying to influence the same event, or they may take opposing values of a two-valued dimension. In its simplest form, only the supporting die need be spun, while concentration is exerted upon the odd-or-even numbered outcome. Movement and success scoring again follows as above.

Other objects and advantages of the present invention will become more readily apparent upon having reference to the accompanying drawings and the following description.

DESCRIPTION OF THE PREFERRED EMBODIMENT

Figure 1:
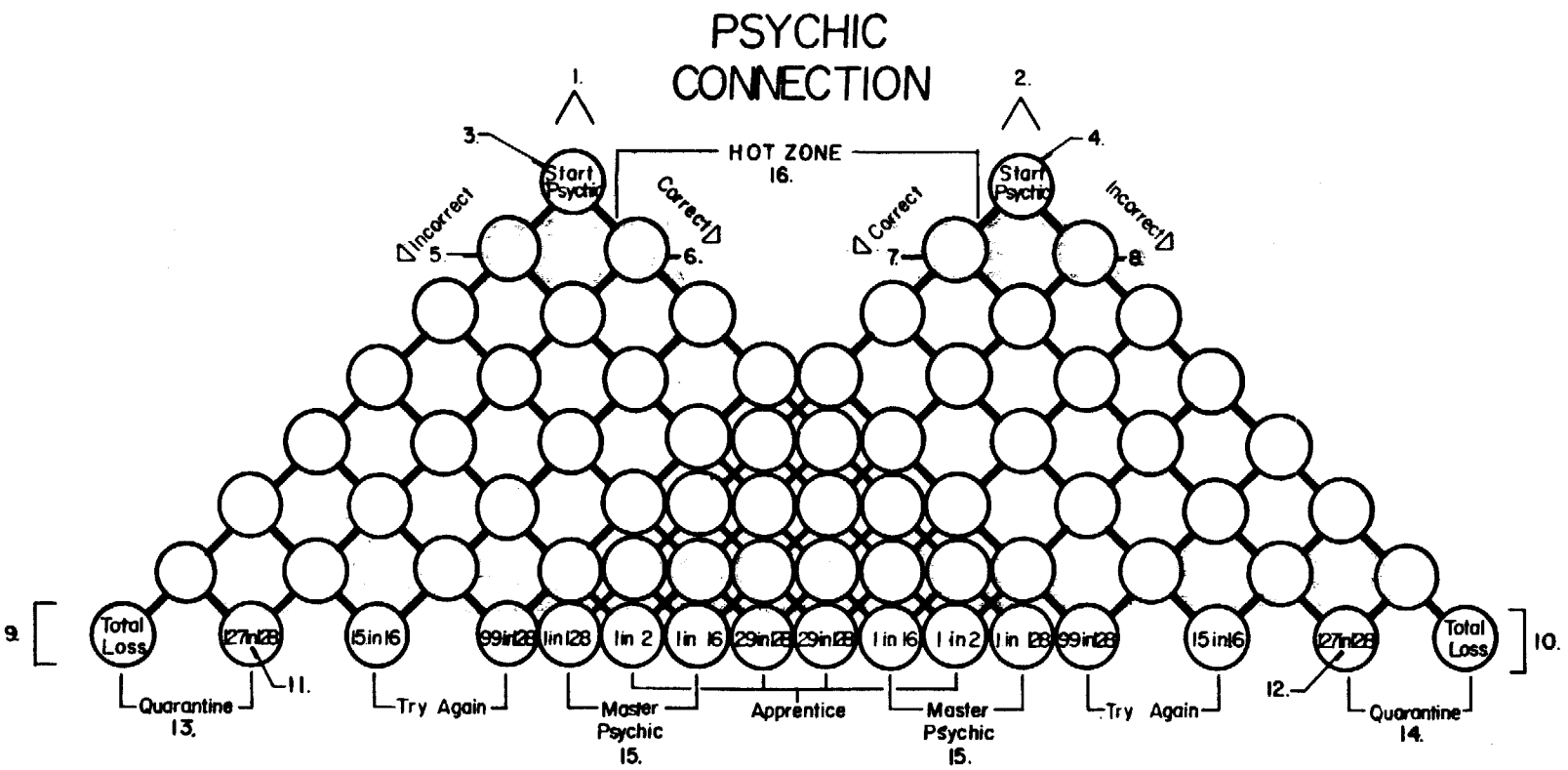
FIG. 1 is a top plan view of one game board embodiment.

In the embodiment illustrated in FIG. 1, the board is configured as an overlapping pair of seven level triangular pyramids. Pyramid 1 is assigned to the first player, and pyramid 2 is assigned to their partner, or opponent. Start positions 3 and 4 are at the top of each player's pyramid. When successful receptions of mental transmissions are made, board movement is toward the opponent. When incorrect receptions are made, movement is away from the other player. Thus on the first round of play, player starting at position 3 will move to position 6 when correctly receiving, and will move to position 5 if incorrect. His partner or opponent will likewise move in his first round to either position 7 if correct, or to position 8 otherwise. Seven levels of positions are provided to coincide with a set of seven rounds of play. Lowest levels 9 and 10 have each position marked with the probabilities 11 and 12 that a player will land on that position. Below the last level, word qualifiers 13 and 14 are used to indicate the overall success achieved in seven turns. Thus a Master Psychic 14 and 15 is one who correctly perceives the correct mental image transmitted seven times in a row. A general region of closeness is indicated as Hot Zone 16.

Figure 2:
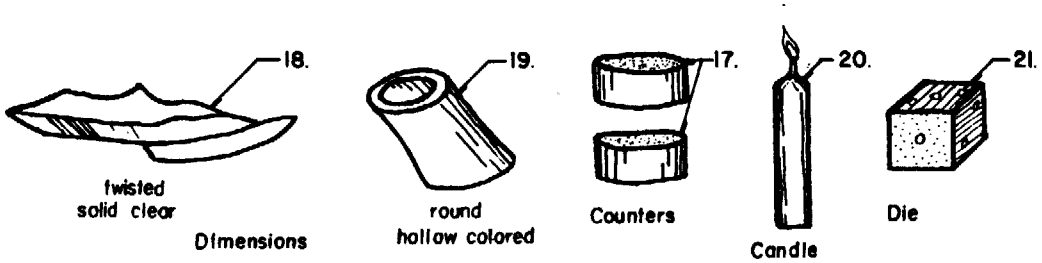
FIG. 2 is a set of isometric views of the game's implements.
Figure 3:
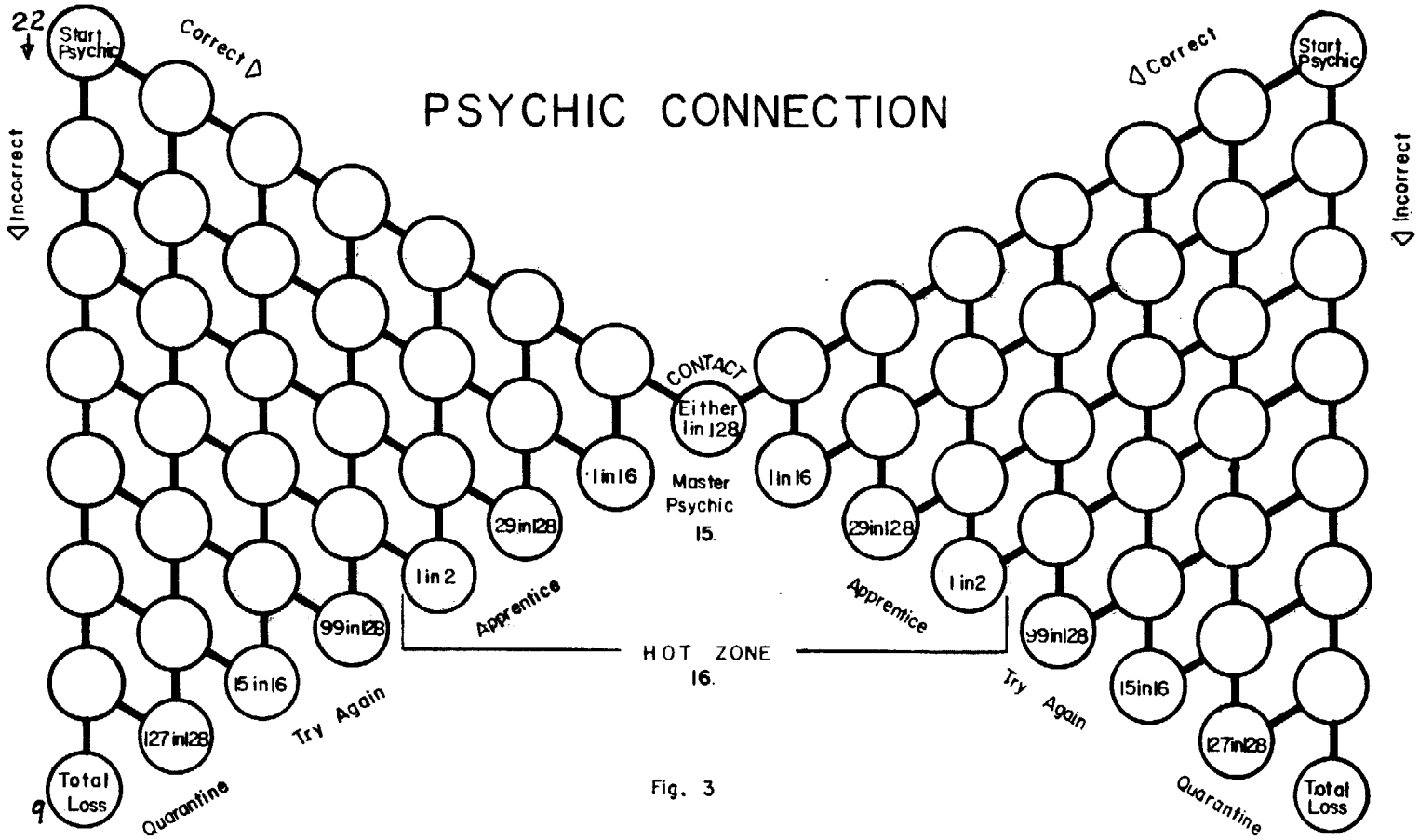
FIG. 3 is a top plan view of an alternate game board embodiment.

Typical implements used in the game are shown in FIG. 2. Pieces representing individual players are illustrated as single counters 17, although it will be recognized that any two different objects could be used. Dimensional objects are shown at 18 and 19. Each piece has a set of opposite pairs of dimensions. Thus, object 18 is twisted while object 19 is round. Object 18 is solid and object 19 is hollow. Object 18 is fabricated from a clear material while 19 is colored. Obviously other opposing dimensional pairs are available, such as heavy-light, smooth-fuzzy. Countless other pairs are available from other bi-valued systems, such as head-tails, on-off, etc.

Supporting implements for the game include candle 20 and die 21. The die 21 may be either used as a one-time choice device, such as choosing sides or counters, or as a bi-valued object in which numbers are either low or high. Since it is a variable device with each roll, it serves as an implement whose resulting position might be influenced during psychokinesis.

It is to be understood that the foregoing description is merely illustrative of the preferred embodiment of the invention and that the scope of the invention is not to be limited thereto, but is to be determined by the scope of the appended claims.

What I claim is:

1. A game apparatus for evaluation and development of psychic abilities, comprising:

a set of objects having at least one pair of multi-valued dimensions, each dimension of which can separately be the object of mental concentration in an attempt to formulate mental images necessary for telepathy, clairvoyance, precognition or psychokinetic phenomena;

a gameboard containing at least two sets of player positions, each set arranged such that net movement is in a particular direction if said mental images are correctly perceived by one or more players and having some positions contain a probability marking denoting the odds of arriving at a given position after a given number of rounds when influenced by random chance alone; and a set of player game pieces to be assigned to individual players to note their relative progress on said gameboard, said game pieces being moved in said particular direction whenever an image transmitted by another is correctly perceived, or whenever a pre-existing value is correctly perceived, or whenever a future value is correctly foreseen, or whenever a future value is correctly influenced by said thought concentration.

2. A game apparatus as recited in claim 1, wherein said sets of player positions are further arranged such that player movement associated with a successful outcome is always in a direction toward the positional set of another player.

3. A method of evaluation and development of telepathic ability comprising the steps of:

providing one or more objects each having at least one multi-valued dimensional attribute;

selecting one value of a dimensional attribute chosen by one or more players;

attempting to transmit said value by thought concentration by said selecting players;

attempting to receive said thought transmission by another set of one or more players;

comparing said received thoughts with said transmissions;

providing a gameboard containing a series of positions in which a positive comparison results in player-piece movement in a particular direction, while a negative comparison results in player-piece movement in the opposite board direction;

comparing the relative telepathic ability by measurement of the net movement in either direction after a preset number of repeat rounds are played; and scoring the effectiveness of the psychic process by comparing a given position on the board with the probability of being there under random chance conditions.

4. A method of evaluation and development of clairvoyance comprising the steps of:

providing one or more objects each having at least one multi-valued dimensional attribute;

selecting blindly one value of a dimensional attribute chosen by one or more players;

attempting to concentrate on and mentally visualize said unknown chosen value;

comparing said mental vision with the actual dimensional value selected;

providing a gameboard containing a series of positions in which a positive comparison results in player-piece movement in a particular direction, while a negative comparison results in player-piece movement in the opposite board direction;

comparing clairvoyance ability by measurement of the net movement in either direction after a preset number of rounds are played; and scoring the effectiveness of the psychic process by comparing a given position on the board with the probability of being there under random chance conditions.

5. A method of evaluation and development of precognitive ability comprising the steps of:

providing one or more objects each having at least one multi-valued dimensional attribute;

attempting to concentrate on and mentally visualize one value of a dimensional attribute that is to be chosen in the future by one or more players;

selecting one value of said dimensional attribute by said one or more players;

comparing said mental vision with the actual dimensional value selected;

providing a gameboard containing a series of positions in which a positive comparison results in player-piece movement in a particular direction, while a negative comparison results in player-piece movement in the opposite board direction;

comparing precognitive ability by measurement of the net movement in either direction after a preset number of rounds are played; and scoring the effectiveness of the psychic process by comparing a given position on the board with the probability of being there under random chance conditions.

6. A method of evaluation and development of psychokinetic ability comprising the steps of:

providing one or more objects each having at least one multi-valued dimensional attribute;

selecting one value of a dimensional attribute chosen by one or more players;

attempting to concentrate on and to mentally influence the value to be selected;

comparing said mental vision with the actual dimensional value selected;

providing a gameboard containing a series of positions in which a positive comparison results in player-piece movement in a particular direction, while a negative comparison results in player-piece movement in the opposite board direction;

comparing psychokinetic ability by measurement of the net movement in either direction after a preset number of rounds are played; and scoring the effectiveness of the psychic process by comparing a given position on the board with the probability of being there under random chance conditions.

* * * * *